US005732312A

United States Patent [19]

Takekoshi et al.

[11] Patent Number: 5,732,312

[45] Date of Patent: Mar. 24, 1998

[54] IMAGE FORMING APPARATUS WITH MOVABLE BELT AND MEANS TO POSITION RECORDING SHEETS THEREON

[75] Inventors: Nobuhiko Takekoshi; Rie Takekoshi, both of Kawasaki, Japan

[73] Assignee: Canon Kabushiki Kaisha, Tokyo, Japan

[21] Appl. No.: 575,677

[22] Filed: Dec. 19, 1995

[30] Foreign Application Priority Data

Dec. 27, 1994 [JP] Japan ..... 6-324385

[51] Int. Cl.[6] ..... G03G 15/01; G03G 15/16

[52] U.S. Cl. ..... 399/160; 347/116; 399/162; 399/299; 399/302; 399/313

[58] Field of Search ..... 355/212, 271, 355/208, 317, 326 R, 327; 399/162, 299, 302, 308, 313, 388, 160, 66; 347/116

[56] References Cited

U.S. PATENT DOCUMENTS

| | | | |
|---|---|---|---|
| 4,232,961 | 11/1980 | Masuda | 355/271 |
| 4,396,275 | 8/1983 | Oka et al. | 355/212 |
| 4,662,739 | 5/1987 | Sakai et al. | 399/66 X |
| 4,903,067 | 2/1990 | Murayama et al. | 355/271 X |
| 5,414,501 | 5/1995 | Miura et al. | 355/271 |
| 5,455,663 | 10/1995 | Inoue et al. | 355/271 |
| 5,541,708 | 7/1996 | Tsuruoka | 355/208 |

FOREIGN PATENT DOCUMENTS 61-39068 2/1986 Japan .

*Primary Examiner*—Arthur T. Grimley
*Assistant Examiner*—Sophia S. Chen
*Attorney, Agent, or Firm*—Fitzpatrick, Cella, Harper & Scinto

[57] ABSTRACT

There is disclosed an image forming apparatus for forming an image on a recording material borne on an endless belt supported by a plurality of rollers, at least one of which creates an area of deformation where the roller is in contact with the belt when the belt is stationary. The recording material is supplied to the belt so as not to cross the center of the area of deformation of the belt in the moving direction thereof.

16 Claims, 6 Drawing Sheets

IMAGE FORMING APPARATUS WITH MOVABLE BELT AND MEANS TO POSITION RECORDING SHEETS THEREON

BACKGROUND OF THE INVENTION

1. Field of the Invention

The present invention relates to an image forming apparatus, such as a copying machine or a printer, and more particularly, to an image forming apparatus that forms images by using an electrostatic transfer process.

2. Description of the Related Art

There have been proposed various image forming apparatuses including the step of sequentially superimposing toner images of a plurality of colors on a single transfer material.

In a typical example of such color image forming apparatuses, a transfer material is borne on an endless belt supported and driven by a plurality of rollers, and the transfer material is sequentially conveyed to transfer positions of a plurality of photoconductive members respectively having toner images thereon. At the respective transfer positions, the toner images are transferred onto the transfer material to thereby form a full-color image.

However, in the above-mentioned color image forming apparatus, if the drive of the belt is stopped for a certain period, deformations caused by the creep phenomenon are left in portions of the belt wound on the rollers.

This phenomenon is particularly prevalent when the diameter of the rollers is small.

If the transfer material is borne on the belt across the top of the deformation, the space caused by the deformation makes it difficult to obtain a good transfer image.

Furthermore, in an image forming apparatus which directly transfers a toner image on a photoconductive member onto a belt and then transfers the toner image formed on the belt onto a transfer material, if an image forming area is set across the top of the above-mentioned deformation of the belt, good transfer cannot be achieved.

SUMMARY OF THE INVENTION

An object of the present invention is to provide an image forming apparatus capable of forming good images without any influence of deformation which is likely to occur in an area of a belt in contact with the peripheral surface of a roller for supporting the belt when the belt is stationary.

In accordance with this object, there is provided an image forming apparatus comprising a movable belt for bearing thereon and conveying a recording material, a plurality of rollers supporting the belt, wherein the belt has at least one area of deformation corresponding to the area of the belt in contact with one of the plurality of rollers when the belt is stationary, image forming means for forming an image on the recording material born and conveyed by the belt and supply means for supplying the recording material to the belt, the supply means supplying the recording material to the belt without crossing a center of the area of deformation of the belt in the moving direction thereof.

In accordance with yet another aspect of the present invention, there is provided an image forming apparatus comprising a belt-like moving member, a plurality of rollers, the rollers arranged to support the moving member, and wherein the moving member has at least one area of deformation corresponding to the area of the moving member in contact with one of the plurality of rollers when the moving member is stationary, an image forming means for forming an image on an area of the moving member that does not cross a center of the area deformation.

These and other objects, features and advantages of the present invention will become more apparent from the following description of the preferred embodiments taken in conjunction with the accompanying drawings.

DETAILED DESCRIPTION OF THE PREFERRED EMBODIMENTS

[First Embodiment]

A first embodiment of the present invention will now be described with reference to FIGS. 1 to 3.

Figure 3:
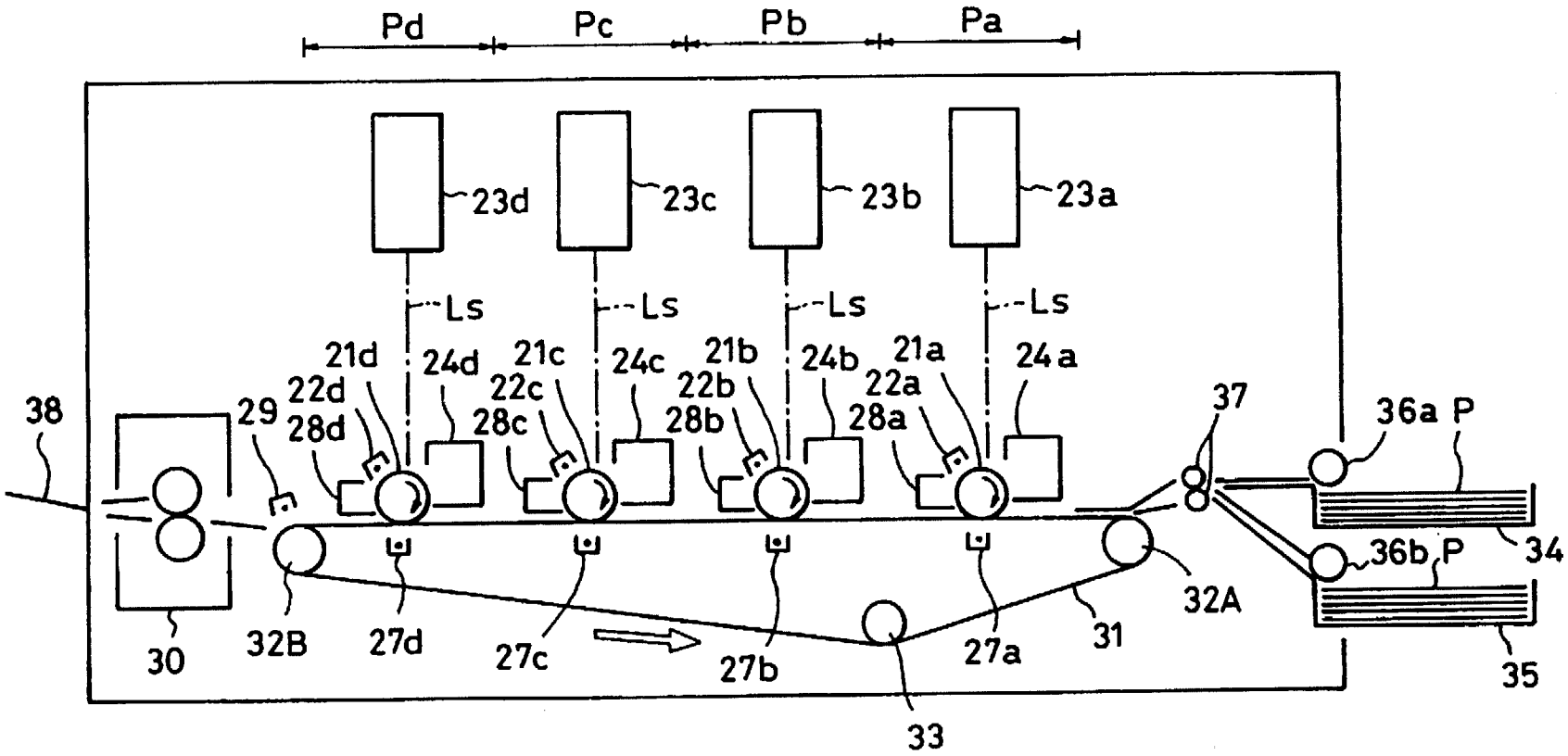
FIG. 3 is a schematic sectional view showing the overall configuration of an electrophotographic color image forming apparatus according to the first embodiment of the present invention.

FIG. 3 shows the overall configuration of an electrophotographic color image forming apparatus to which the present invention may be applied. This color image forming apparatus comprises first, second, third and fourth image forming portions Pa, Pb, Pc and Pd in a main body thereof. A sheet feeding portion is located on one side of the apparatus, that is, on the right side of FIG. 3, and a fixing device 30 is located on the opposite side, that is, on the left side of FIG. 3. Below a path leading from the sheet feeding portion to the fixing device 30 in the apparatus body is a recording material bearing belt 31, serving as an endless moving member, for bearing and conveying a recording material. The recording material bearing belt 31 is stretched between a plurality of rollers in a well-known manner. The recording material bearing belt 31 bears a recording material P fed through the sheet feeding portion, and is driven in a direction of the arrow in FIG. 3 to sequentially convey the recording material P to the above-mentioned image forming portions Pa, Pb, Pc and Pd.

The image forming portions Pa, Pb, Pc and Pd have substantially the same structure, and include photoconductive drums 21*a*, 21*b*, 21*c* and 21*d*, respectively, as image bearing members to be rotated in the direction of the arrow. Image forming means are placed around the respective photoconductive drums. Although these image forming means may be of a variety of known image forming devices, in this embodiment, primary chargers 22*a*, 22*b*, 22*c* and 22*d* for uniformly charging the photoconductive drums, developing devices 24*a*, 24*b*, 24*c* and 24*d* for developing electrostatic latent images formed on the photoconductive drums, transfer chargers 27*a*, 27*b*, 27*c* and 27*d* for transferring developed visible images (toner images) onto the recording material P, and cleaners 28*a*, 28*b*, 28*c* and 28*d* for removing toner left on the photoconductive drums, are arranged in order in the drum rotating direction. Furthermore, image exposure devices 23*a*, 23*b*, 23*c* and 23*d* are provided above the photoconductive drums 21*a*, 21*b*, 21*c* and 21*d*, respectively.

The developing devices 24*a*, 24*b*, 24*c* and 24*d* respectively contain black, yellow, magenta and cyan toner. The image exposure devices 23*a*, 23*b*, 23*c* and 23*d*, each of which is comprised of a semiconductor laser, a polygon mirror, an fθ lens and the like in this embodiment, respectively receive input electric digital pixel signals, and scan the surfaces of the photoconductive drums for exposure in the bus direction thereof with laser beams Ls modulated according to the signals between the primary chargers 22*a*, 22*b*, 22*c* and 22*d* and the developing devices 24*a*, 24*b*, 24*c* and 24*d*, thereby forming an electrostatic latent image on each of the photoconductive drums 21*a* to 21*d*. A pixel signal corresponding to a black component image of a color image, a pixel signal corresponding to a yellow component image, a pixel signal corresponding to a magenta component image and a pixel signal corresponding to a cyan component image are input to the image exposure devices 23*a*, 23*b*, 23*c* and 23*d*, respectively. An appropriate recording material absorption means, which is not shown, is placed between the first image forming portion Pa and the sheet feeding portion so as to reliably absorb the recording material P, supplied from the sheet feeding portion, onto the recording material bearing belt 31. On the other hand, a discharger 29 to which an AC voltage is applied is placed between the fourth image forming portion Pd and the fixing device 30 to separate the recording material P absorbed on the recording material bearing belt 31.

The recording material bearing belt 31 is formed by splicing both ends of a film sheet made of a dielectric resin, such as polyurethane resin, PVDF (polyvinylidene fluoride) resin, PET (polyethylene terephthalate) resin, polycarbonate resin, or polyether sulfone resin, in endless form by means of ultrasonic fusion or the like, and is driven endlessly by driving rollers 32A and 32B at both ends at a constant velocity (for example, 100 mm/s) in the direction of the arrow in FIG. 3. An intermediate roller 33 is a tension roller used to adjust the tension of the belt 31.

The above sheet feeding portion is comprised of two sheet supply cassettes 34 and 35 containing recording materials P different in size, sheet feed rollers 36*a* and 36*b* for supplying the recording materials P one by one from the sheet supply cassettes 34 and 35, respectively, and register rollers 37 for feeding each recording material P onto the recording material bearing belt 31 at a preset timing.

In the color image forming apparatus having the above configuration, when a recording material P is guided by a sheet supply guide and supplied onto the recording material bearing belt 31, it is absorbed thereon electrostatically and reliably by the action of the recording material absorption means. In correlation to the movement of the recording material bearing belt 31 in the direction of the arrow in FIG. 3, black, yellow, magenta and cyan visible images are formed separately on the photoconductive drum 21*a* in the first image forming portion Pa, the photoconductive drum 21*b* in the second image forming portion Pb, the photoconductive drum 21*c* in the third image forming portion Pc and the photoconductive drum 21*d* in the fourth image forming portion Pd. These visible images are sequentially transferred, one over the other, on the recording material P by the transfer chargers 27*a*, 27*b*, 27*c* and 27*d* in the image forming portions while the recording material P is passed under the photoconductive drums 21*a* to 21*d* in the first to fourth image forming portions Pa to Pd in correlation to the movement of the recording material bearing belt 31 and conveyed toward the fixing device 30, by which a composite color image is formed. After passing through the fourth image forming portion Pd, the recording material P is electrically discharged by the discharger 29 to which AC voltage is applied, and separated from the recording material bearing belt 31. The recording material P separated from the recording material bearing belt 31 is conveyed to the fixing device 30, where the multiple composite image transferred thereon is fixed, and then, ejected through a recording material ejection port to an ejection tray 38. Thus, one copying cycle is completed.

Figure 1A:
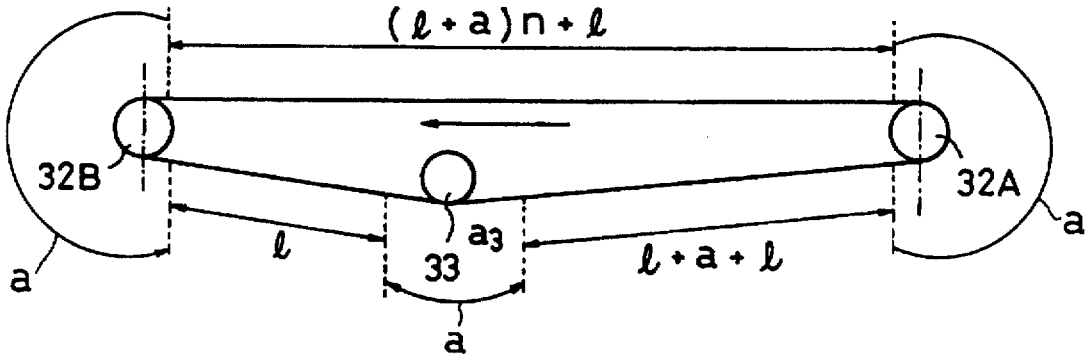
FIGS. 1(A) and 1(B) are views illustrating the supply of a recording material P to a recording material bearing belt 31 according to a first embodiment of the present invention.
Figure 1B:
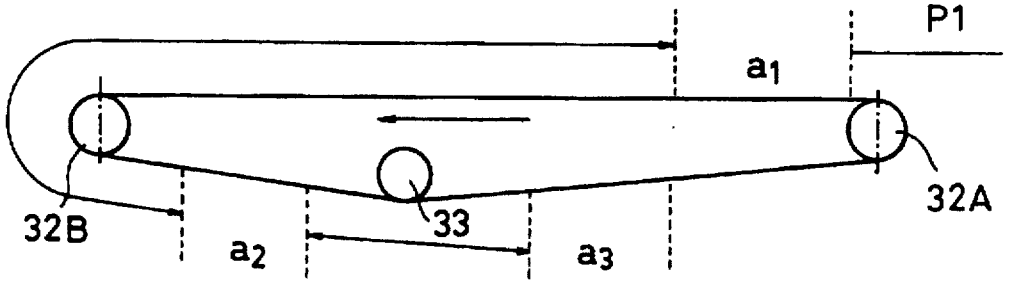

The recording material bearing belt 31 is stretched between the rollers 32A, 32B and 33, each roller of 20 mm in diameter, as shown in FIG. 1, and areas of deformation are formed in those areas of the recording material bearing belt 31 shown as areas $a_1$, $a_2$ and $a_3$, which are in contact with the peripheral surfaces of the rollers 32A, 32B and 33 for long periods of time.

Therefore, the supplied recording material P must be positioned on the recording material bearing belt 31 so as not to be affected by the areas of deformation when toner images are transferred thereon.

Accordingly, in this embodiment, the recording material P is supplied to the recording material bearing belt 31 at a portion away from the above areas of deformation.

In this case, if the total perimeter of the recording material bearing belt 31 is determined arbitrarily, when image forming is performed while continuously supplying a plurality of recording materials P to the recording material bearing belt 31 in response to input of one image forming start signal from the outside of the apparatus through a copy button or the like, the recording materials P may not be supplied at regular intervals.

Accordingly, in this embodiment, when it is assumed that the length of a recording material P of A4 size in the moving direction of the recording material bearing belt 31, is 1, the interval between recording materials to be continuously supplied is a, and the natural number is n, the total perimeter L of the recording material bearing belt 31 is determined such as to be equal to n(1+2), by which the above-mentioned disadvantage is eliminated. In this case, the interval a between recording materials is required to be at least 50 mm to prevent sheet jamming and the like, and thus interval a also corresponds to the area of deformation measured in the moving direction of the belt.

In this embodiment, 1, a, n and L are set at 210 mm, 60 mm, 6, and 1620 mm, respectively, thereby satisfying the formula:

$$L=n(1+a)$$

Furthermore, the dimensions in this embodiment are set such that three A4-size recording materials P are carried between the rollers 32A and 32B, one A4-size recording material P is carried between the rollers 32B and 33, and two A4-size recording materials P are carried between the rollers 33 and 32A.

Therefore, in the image forming apparatus of this embodiment, if a plurality of recording materials are continuously supplied to the belt 31 in response to input of one image forming start signal, the first recording material P1 is supplied immediately after deformations $a_1$ to $a_3$, and subsequent recording materials are each supplied at a distance of 60 mm from the rear end of the previous recording material, by which subsequent recording materials avoid being positioned on the deformations $a_1$ to $a_3$ of the recording material bearing belt 31.

Figure 2:
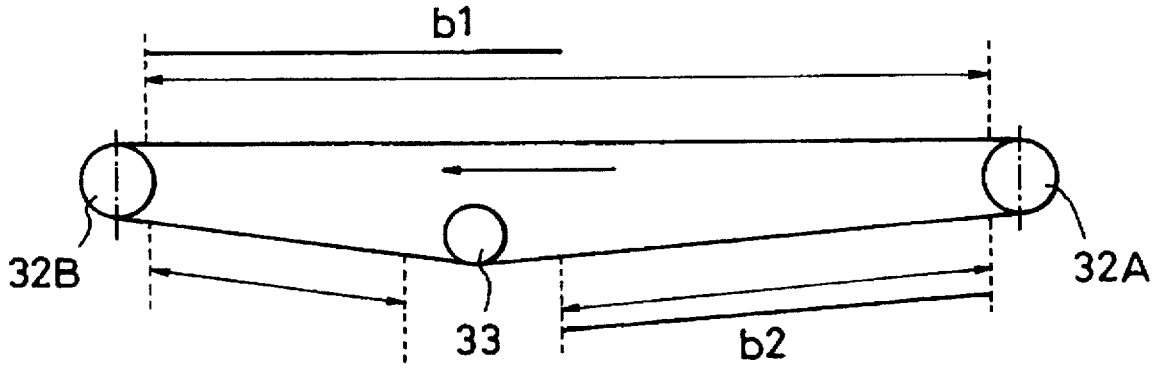
FIG. 2 is a view explaining a state in which a recording material P is supplied to the recording material bearing belt 31 according to the first embodiment of the present invention.

Similarly, if the recording material P is A3-size, L=1620 mm holds when 1, a and n are respectively set at 420 mm, 390 mm and 2 as shown in FIG. 2. In FIG. 2, b1 and b2 denote areas on which paper is laid. In this embodiment, since the diameter of all the rollers 32A, 32B and 33 is 20 mm, which is a small diameter, the recording material P is supplied onto the belt 31 away from three deformations $a_1$ to $a_3$. However, if a plurality of rollers having different diameters are used, good image forming can be achieved by avoiding at least the deformation caused by the roller having the smallest diameter since the roller with the smallest diameter causes the severest deformation.

[Second Embodiment]

Figure 5:
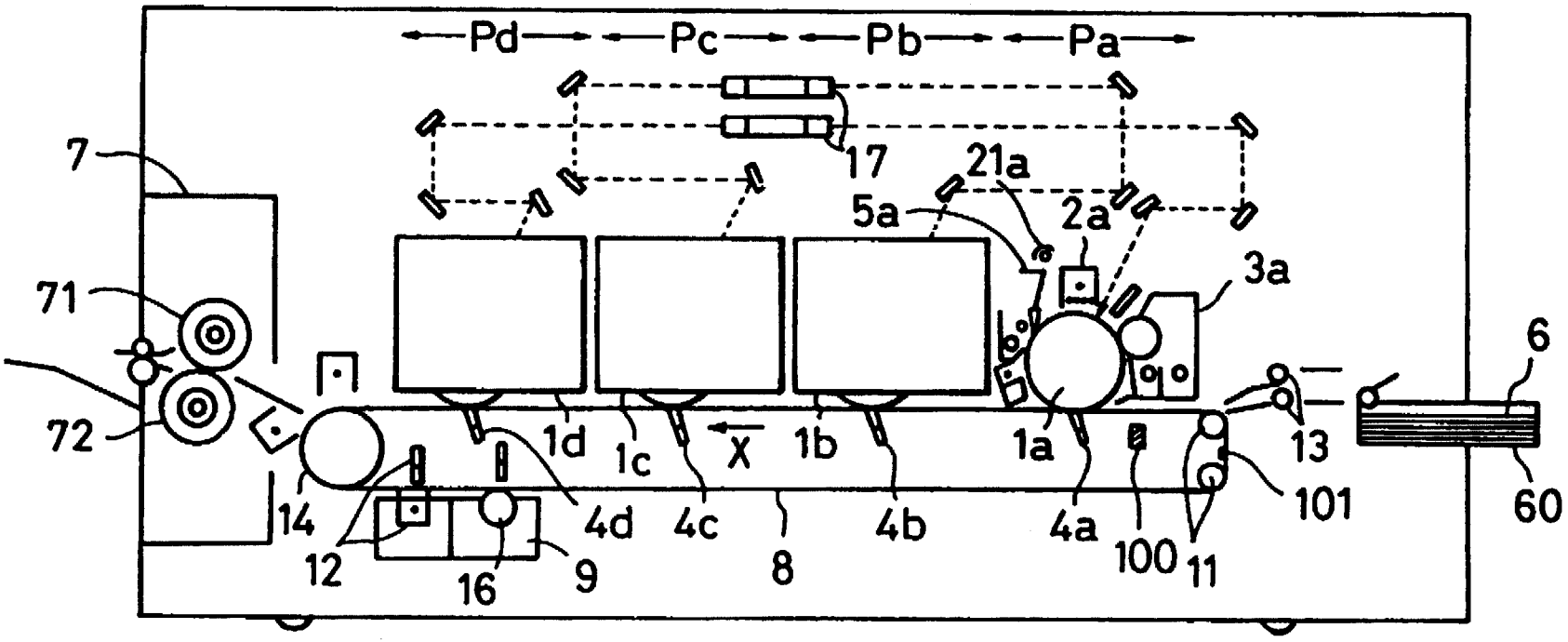
FIG. 5 is a schematic sectional view showing an electrophotographic color image forming apparatus according to a second embodiment of the present invention.

An image forming apparatus in accordance with the second embodiment is illustrated in FIG. 5.

In a main body of the image forming apparatus, an endless belt 8 is provided as a moving member which travels in the direction of the arrow X in FIG. 5. Initially, a transfer material 6 fed from a cassette 60 is supplied to the belt 8 through register rollers 13, and further conveyed toward the left as viewed in FIG. 5.

In the case illustrated, four image forming portions Pa, Pb, Pc and Pd, which have substantially the same structure, are arranged in series on the endless belt 8. Only the internal structure of the image forming portion Pa is illustrated.

Since the image forming portions Pa to Pd all have the same structure, a brief description will only be given for the image forming portion Pa. The image forming portion Pa includes an image bearing member 1*a* shaped like a rotating cylinder, and image forming members, such as a primary charger 2*a*, a developing device 3*a* a transfer charging means 4*a* and a cleaner 5*a*, arranged around the image bearing member 1*a*. The image forming portion Pb, Pc and Pd have a similar structure, and only image bearing members 1*b*, 1*c* and 1*d* thereof are illustrated except for charging means 4*b*, 4*c* and 4*d* which are shown. It is assumed that developing devices located in the image forming portions contain magenta, cyan, yellow and black toner, respectively.

An electrostatic latent image is formed by projecting an image signal corresponding to a magenta component color on a document onto the image bearing member 1*a* through polygon mirrors 17 and the like, and developed with magenta toner supplied from the developing device 3*a*, thereby obtaining a magenta toner image. When the toner image reaches a transfer portion, where the image bearing member 1*a* and the endless belt 8 are put into contact with each other, in correlation to the rotation of the image bearing member 1*a*, the toner image is transferred onto a transfer material 6, which has been taken out of the cassette 60 and has already reached the transfer portion. The toner is transferred by transfer bias applied by a transfer charging means 4*a* in contact with the transfer belt 8. After toner transfer, residual toner left on the image bearing member 1*a* is removed by the cleaner 5*a*, and residual charge is removed by a pre-exposure means 21*a*, by which the image bearing member 1*a* is made to be ready for the next image forming operation.

When the transfer material 6 bearing the magenta toner image is conveyed to the image forming portion Pb by the belt 8, a cyan toner image, which has already been formed on the image bearing member 1*b* by this time in a similar manner to above, is transferred onto the transfer material 6.

Similarly, as the transfer material 6 advances to the image forming portions Pc and Pd, yellow and black toner images are superimposed on the above toner image in respective transfer portions, and then, the transfer material 6 bearing the toner image is separated from the belt 8 and conveyed to a fixing device 7. In the fixing device 7, a fixing roller 71 and a pressure roller 72 are in pressing contact with each other. The above transfer material 6 is fed to a nip portion between these rollers, where a color image is fixed thereon by application of pressure and heat, and the transfer material 6 is ejected to the outside of the apparatus.

A discharger 12 and a cleaning fur brush 16 are arranged in a position which corresponds to a return course of the conveyor belt 8 to remove charges, toner and the like adbering to the belt 8 and deposits removed toner in a container 9.

The above-mentioned belt 8 may be fabricated from many different kinds of polystomer and elastomer materials, such as polyethylene terephthalate resin (PET), polyvinylidene fluoride resin (PVDF), polycarbonate resin (PC), polyurethane resin (PV) and polyimide resin (PI).

The transfer belt 8 is supported and rotationally driven by a driving roller 14 of 50 mm in diameter and two support rollers 11 of 20 mm in diameter.

Experiments conducted by the present applicant reveal that severe areas of deformation arise when the diameter of the support rollers for supporting the belt is smaller than 40 mm and further reveal that good image formation cannot be achieved when an image forming area is set across the center of the deformation in the moving direction of the belt.

Since the driving roller 14 has a diameter of 50 mm, relatively few deformations arise in an area of the belt 8 in contact with the peripheral surface of the driving roller 14 when the belt 8 is stationary, and deformations arise severely in areas of the transfer belt 8 that are in contact with the peripheral surfaces of the support rollers 11 when the belt 8 is stationary.

Figure 6:
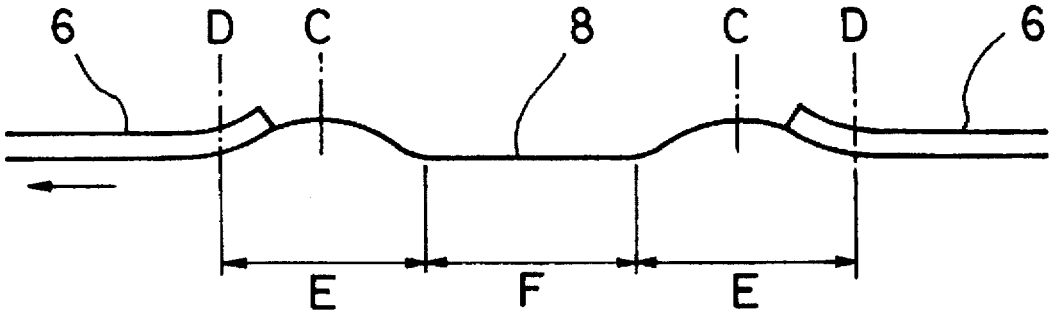
FIG. 6 is a view showing an area of deformation of a transfer belt 8 in the second embodiment of the present invention.

Therefore, two deformations are caused on the belt 8 by the support rollers 11, as shown in FIG. 6 in this embodiment.

Accordingly, this embodiment, as shown in FIG. 6, supplies the recording material 6 onto the transfer belt 8 so as not to cross a center portion C of an area of the transfer belt 8 in the moving direction thereof in contact with the peripheral surface of the support rollers 11 when the transfer belt 8 is stationary, by which good transfer is achieved without any influence from deformation.

It is essentially preferable that the transfer material 6 not lie over areas of deformation denoted by E in FIG. 6, and instead lie between those areas of deformation such as the area denoted by F. In FIG. 6, when F=20, E=20π/4. However, as shown in this embodiment in FIG. 6, the leading or rear edge of the transfer material 6 is laid over the area of deformation so as not to cross the center portion C thereof in order to make a non-image area of the transfer belt 8 having no transfer material as short as possible, to thereby reduce the size of the apparatus and to achieve high-speed continuous image formation.

Figure 7:
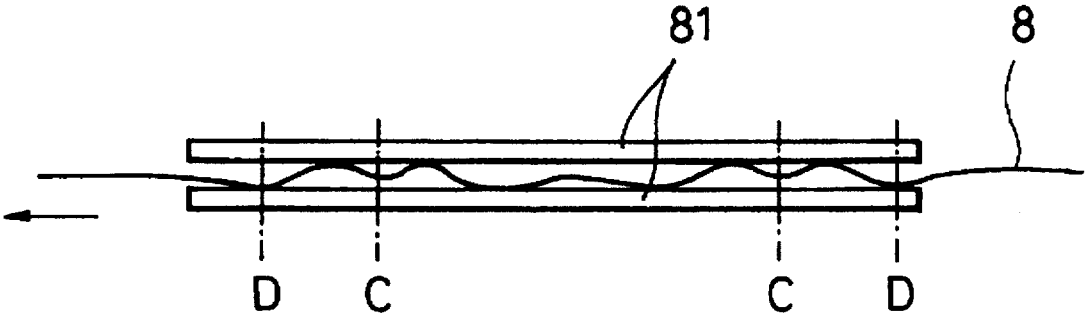
FIG. 7 is a view showing a state in which the area of deformation of the transfer belt 8 is pressed by flat plates 81 in the second embodiment of the present invention.

FIG. 7 shows a case in which the transfer belt 8 having two areas of deformation shown in FIG. 6 is pressed by two flat plates 81.

Since each of top portions C of the deformations are convexly transformed, they have a large repulsion counteracting the pressing force of the flat plates 81, and therefore will slacken to form a space between them and the upper flat plate 81.

On the other hand, although small slacks occur near portions D of the belt 8, they are less serious than at the center portions C.

Therefore, it is possible to prevent poor transfer due to deformation of the transfer belt 8 and to lengthen the available image area on the transfer belt 8 by setting the position of the transfer material 6 with respect to the belt 8 as shown in FIG. 6.

As shown in FIG. 5, a black tape 101 is stuck as a sensing mark between the deformations on the transparent transfer belt 8 to be sensed by a transmission sensor 100.

After image formation, the black tape 101 is put in a predetermined position between the rollers 11 based on a sensing signal from the sensor 100, thereby stopping the transfer belt 8.

The transfer material 6 is supplied onto the transfer belt 8 a predetermined time after an image forming start signal is input through a copy button or the like, and the transfer material 6 is borne in a predetermined position on the transfer belt 8.

As described above, in this embodiment, the transfer material 6 is supplied to the transfer belt 8 so that it does not cross the center portion C of the deformation formed on the belt 8 by the rollers 11 having the smallest diameter among a plurality of rollers 11 and 14.

However, it is preferable, depending on the material of the transfer belt 8 or the like, that the transfer material be supplied to the belt 8 so as not to cross the center portion of an area of the belt 8, which is in contact with the peripheral surface of the driving roller 14 when the belt 8 is stationary, either.

[Third Embodiment]

Figure 4:
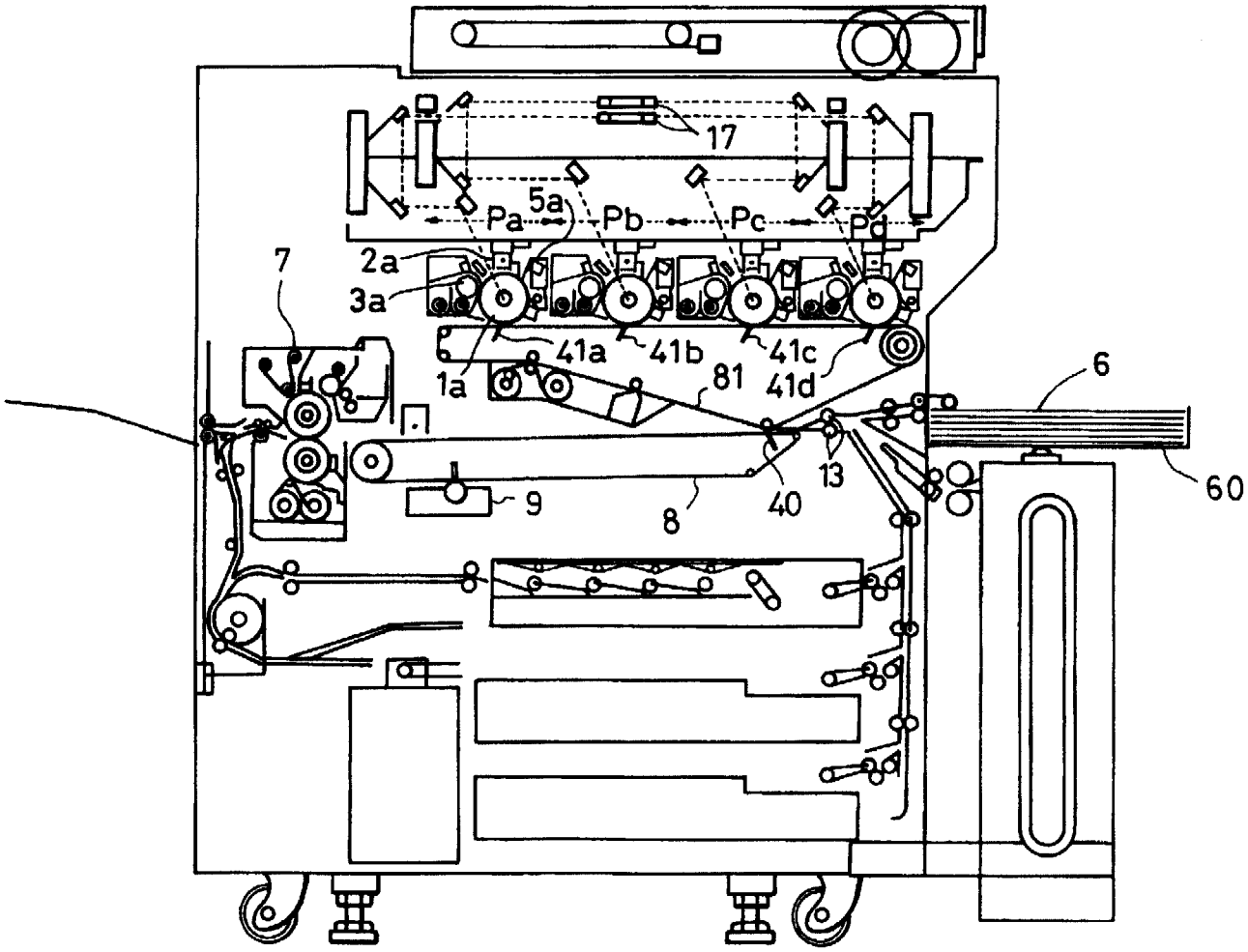
FIG. 4 is a schematic sectional view showing the configuration of the principal part of an electrophotographic color image forming apparatus according to a third embodiment of the present invention.

Although the present invention is applied to a recording material bearing belt in the first and second embodiments, it is not so limited. Another embodiment of the present invention will be described with reference to FIG. 4. FIG. 4 is a cross sectional view of a color image forming apparatus in which first and second image bearing members are provided, a visible image on the first image bearing member is transferred onto the second image bearing member, and an intermediate transfer belt as a moving member is used to transfer the visible image from the second image bearing member onto a recording material. Components substantially the same as those depicted in other Figs. are identified by the same reference numbers.

As is illustrated, four image forming portions Pa, Pb, Pc and Pd substantially having the same structure are arranged in series above intermediate transfer member 81. Only the internal structure of the image forming portion Pa is illustrated, and the illustration of other image forming portions is omitted.

Since the image forming portions Pa to Pd all have the same structure, a brief description will be given only of the image forming portion Pa. The image forming portion Pa comprises an image bearing member 1*a* shaped like a rotating cylinder, and image forming members, such as a primary charger 2*a*, a developing device 3*a* and a cleaner 5*a*, arranged around the image bearing member 1*a*. The image forming portions Pb, Pc and Pd have the same structure as above. It is assumed that developing devices in the image forming portions contain magenta, cyan, yellow and black toner, respectively.

An electrostatic latent image is formed by projecting an image signal corresponding to a magenta component color on a document onto the image bearing member la through polygon mirrors 17 and the like, and is developed with magenta toner supplied from the developing device 3*a*, thereby obtaining a magenta toner image. When this magenta toner image reaches a transfer portion, where the image bearing member 1*a* and the belt-like intermediate transfer member 81 are put in contact with each other, in correlation to the rotation of the image bearing member 1*a*, the magenta toner image is transferred onto the intermediate transfer member 81 by transfer bias applied by a first intermediate transfer means 41*a* in contact with the intermediate transfer member 81. When the intermediate transfer member 81 bearing the magenta toner image is conveyed to the image forming portion Pb, a cyan toner image, which has been formed on the image bearing member 1*b* in the image forming portion Pb in a similar manner to above, is transferred onto the magenta toner image by a second intermediate transfer means 41*b*.

Similarly, yellow and black toner images are superimposed on the above toner images in first transfer portions of the image forming portions Pc and Pd by third and fourth intermediate transfer means 41*c* and 41*d*, respectively. After that, the above toner images of four colors are transferred together onto a transfer material 6, which has been taken out of a cassette 60 and already conveyed to a second transfer portion by a transfer belt 8, by transfer bias applied from a transfer means 40. Then, residual toner left on the image bearing member 1*a* is removed by the cleaner 5*a*, by which the image bearing member 1*a* is made to be ready for the next image forming operation.

In the color electrophotographic recording apparatus having the above structure, the same advantages as those of the first and second embodiments can be obtained by setting the position of a toner image formed on the belt-like intermediate transfer member 81 supported by a plurality of support rollers in a similar manner to the above embodiments, that is, by determining an image forming area so as not to cross the center of deformation areas of the intermediate transfer member 81 in contact with the peripheral surfaces of the support rollers in the moving direction of the intermediate transfer member 81 when the intermediate transfer member 81 is stationary.

Furthermore, the same advantages can be obtained by applying the present invention to a photoconductive belt.

While the present invention has been described with respect to what is presently considered to be the preferred embodiments, it is to be understood that the invention is not limited to the disclosed embodiments. The present invention is intended to cover various modifications and equivalent arrangements included within the spirit and scope of the appended claims.

What is claimed is:

1. An image forming apparatus, comprising:

a movable belt for bearing thereon and conveying a recording material;

a plurality of rollers for supporting said belt;

image forming means for forming an image on the recording material borne on and conveyed by said belt; and supply means for supplying the recording material to said belt, wherein when said supply means continuously supplies a plurality of recording materials to said belt, it supplies the recording materials to said belt, regardless of the number of the recording materials, so as not to cross the center of an area of said belt in a moving direction thereof in contact with a peripheral surface of a small roller having the smallest diameter of said plurality of rollers when said belt is stationary, wherein in the moving direction of said belt a perimeter of said belt is an integral multiple of the sum of a length of said recording material and a distance between successive recording materials.

2. An image forming apparatus according to claim 1, wherein each of said plurality of rollers has the same diameter, and said supply means supplies the recording material to said belt so as not to cross the center of an area of said belt in the moving direction thereof in contact with the peripheral surface of each of said plurality of rollers when said belt is stationary.

3. An image forming apparatus according to claim 1, wherein said supply means supplies the recording material to said belt without contacting any of said area of said belt in contact with the peripheral surface of said small roller when said belt is stationary.

4. An image forming apparatus according to claim 1, further comprising sensing means for sensing a position of said belt in the moving direction thereof.

5. An image forming apparatus according to claim 4, wherein said belt stops at a predetermined position based on the sensing result of said sensing means.

6. An image forming apparatus according to claim 1, wherein said image forming means includes image bearing means for bearing an image thereon, and transfer means for transferring the image formed on said image bearing means onto the recording material borne on said belt.

7. An image forming apparatus according to claim 6, wherein said transfer means is in contact with said belt.

8. An image forming apparatus according to claim 6, wherein said image bearing means has a plurality of image bearing members, and a plurality of images are sequentially transferred, one over the other, onto the recording material borne on said belt.

9. An image forming apparatus, comprising:

a belt-like moving member;

a plurality of rollers for supporting said moving member; and image forming means for forming an image on said moving member, said image forming means setting an image forming area on said moving member, wherein when said image forming means continuously forms a plurality of images on said moving member, it sets image forming areas on said moving member, regardless of the number of images to be formed by said image forming means, so as not to cross the center of an area of said moving member in a moving direction thereof in contact with a peripheral surface of a small roller having the smallest diameter of said plurality of rollers when said moving member is stationary, wherein in the moving direction of said moving member a perimeter of said moving member is an integral multiple of the sum of a length of said image forming area and a distance between said successive image forming areas.

10. An image forming apparatus according to claim 9, wherein each of said plurality of rollers has the same diameter and said image forming means sets the image forming area on said moving member so as not to cross the center of an area of said moving member in the moving direction thereof in contact with the peripheral surface of each of said plurality of rollers when said moving member is stationary.

11. An image forming apparatus according to claim 9, wherein said image forming means sets the image forming area on said moving member without contacting any of the area of said moving member in contact with the peripheral surface of said small roller when said moving member is stationary.

12. An image forming apparatus according to claim 9, wherein said image forming means includes image bearing means for bearing an image thereon, and transfer means for transferring the image formed on said image bearing means onto said moving member.

13. An image forming apparatus according to claim 12, wherein said transfer means is in contact with said moving member.

14. An image forming apparatus according to claim 12, wherein said image bearing means includes a plurality of image bearing members for sequentially transferring a plurality of images, one over the other, onto said moving member.

15. An image forming apparatus according to claim 12, further comprising second transfer means for transferring the image formed on said moving member onto the recording material.

16. An image forming apparatus according to claim 9, wherein said moving member is a photoconductive member.

* * * * *

UNITED STATES PATENT AND TRADEMARK OFFICE

CERTIFICATE OF CORRECTION

PATENT NO. : 5,732,312
DATED : March 24, 1998
INVENTOR(S) : Nobuhiko TAKEKOSHI, et al.

It is certified that error appears in the above-identified patent and that said Letters Patent is hereby corrected as shown below:

Column 1, line 55, delete "born" and insert therefor --borne--.

Column 2, line 3, after "area", insert --of--.

Column 4, line 46, delete "1" and insert therefor --l--;
Line 50, delet "1" and insert therefor --l--; and
Line 56, delete "1" and insert therefor --l--.

Column 5, line 11, delete "1" and insert therefor --l--.

Signed and Sealed this

Thirteenth Day of October 1998

*Attest:*

*Attesting Officer*

Bruce Lehman

BRUCE LEHMAN

*Commissioner of Patents and Trademarks*